United States Patent [19]

Russell, Jr.

[11] 3,957,125

[45] *May 18, 1976

[54] MULTI-STAGE DOUBLE-ACTING EXTENDIBLE AND CONTRACTIBLE SHAFT DRIVE FOR DRILLING DEVICE

[76] Inventor: Wayne B. Russell, Jr., 3895 Lugo Ave., Lynwood, Calif. 90262

[ * ] Notice: The portion of the term of this patent subsequent to Oct. 30, 1990, has been disclaimed.

[22] Filed: Nov. 21, 1973

[21] Appl. No.: 418,073

Related U.S. Application Data

[63] Continuation-in-part of Ser. No. 177,592, Sept. 3, 1971, abandoned.

[52] U.S. Cl. ..... 173/150; 64/23; 92/53; 175/321; 175/381

[51] Int. Cl.[2] ..... E21B 3/02

[58] Field of Search ..... 173/150; 175/162, 195, 175/321; 64/23; 91/169, 167, 168; 92/53, 51, 52

[56] References Cited

UNITED STATES PATENTS

| | | | |
|---|---|---|---|
| 2,066,794 | 1/1937 | Miller | 64/23 X |
| 2,634,950 | 4/1953 | Allen | 173/150 |
| 2,741,461 | 4/1956 | Joy | 173/150 X |
| 2,783,744 | 3/1957 | Tennis | 91/169 X |
| 2,847,188 | 8/1958 | Wiltse | 173/150 |
| 3,128,674 | 4/1964 | Gancher et al. | 91/169 X |
| 3,768,578 | 10/1973 | Russell | 173/150 |

*Primary Examiner*—Ernest R. Purser
*Attorney, Agent, or Firm*—D. Gordon Angus; Donald D. Mon

[57] ABSTRACT

A uniquely integrated arrangement of concentric tubes in combination with concentric pistons and special interconnecting fluid pressure passages therein, said component members cooperating in a manner as to permit extreme compound extension or retraction, while special cross-section configuration allows efficient transmission of axial torque energy without slippage between collinear members, so that when driven as a Kelly drive for earth drilling the torque is transmitted to a drilling auger.

9 Claims, 7 Drawing Figures

29a
29

31
33
35

28a
28

27
27a

23
Z
Y

Z
Y
23
2
2
27
27a
3
3
28a
41
4
4
28
43
5
5
45
29a
6
6
34
48
31
54
35
47
32
46
51
50
40
24
24b
36
33
53
25
28b
52
42
29
44
26
29b
49
30
38
37
39

MULTI-STAGE DOUBLE-ACTING EXTENDIBLE AND CONTRACTIBLE SHAFT DRIVE FOR DRILLING DEVICE

This is a continuation-in-part of application Ser. No. 177,592, filed Sept. 3, 1971, now abandoned.

This invention relates to multiple-stage jacks, telescoping arms, extendible drilling shafts and like equipment, and more specifically the invention provides the ability to extend linearly from an extremely compact state of withdrawal, to that of an enormously telescoped structure that is positively reversible, that is to say, double-acting from any given position thereof. Note that while the term "fluid" is used in reference to the motivating medium, it is herein applied to include hydraulic or pneumatic systems; and the terms "cylinder," "tube" or "tubular" are applied herein to broadly include all cross-section configurations outlined in the text.

Hence, the invention revealed herein is suitable to varied applications as related to basic cylinder service such as might be applied in the tilting of a dump-truck bed for example; or may be altered to replace conventional rotary shaft driving members commonly known as Kelly-drives, and thereby permit extremely deep holes to be easily drilled; or this cylinder invention may be uniquely adapted to inverted drive wherein the outer cylinder is positively rotatable via drive from the innermost shaft member, at the same time being extendible or retractable via separate collinear hollow routing of pressurized fluid through the said central shaft member.

Another unusual optional modifying application of the invention is obtained by virtue of a shuttle-barrel housed about the basic cylinder assemblage, this said barrel member in turn supporting an auger drilling tool around its circumference, and so combined serves to effect a reduction in overall design height of an entire drill-rig mast to a much lower profile in order that standard garage entrance-way heights be cleared, for example; thus, enabling such a portable drill-rig to drive right into a typical building site and commence to immediately drill a floor sump for installation of a hydraulic lift; thus, obviating costly partial knockdown disassembly of either equipment or building structure as in the past.

Two other patent applications, directly related in function to the foregoing equipment operation, have been filed by this inventor; the first, is identified as application Ser. No. 172,488, filed Aug. 17, 1971, now U.S. Pat. No. 3,747,697, entitled "Self-loading Drill-rig Hopper," wherein is comprised a system which combines synergistically with the "shuttle-barrel/auger drilling apparatus," having a high "spin-off" unloading capability, permitting it to empty extracted drillings directly upward within the unique surrounding bed of the hopper-cart. The second, identified as application Ser. No. 175,562, filed Aug. 27, 1971, now U.S. Pat. No. 3,756,330, entitled "Operator Safety Oriented Earth Auger," comprises provisions of operator safety and operating efficiency as related to the drill-rig structure itself. Thus, laborious man/machine efforts are reduced to a fraction of the time factor required by conventional drilling apparatus methods.

Equipment applications which subject the cylinder/-piston members to torsional loadings as in the preceding paragraph, may comprise any number of different cross-section designs such as hexagonal, octagonal, triangular, or splined; however the design most preferred by this inventor is the square cross-section which it is felt offers the best combination of stator-like resistance to torque loadings, and fabrication economy factors. Naturally, the standard round cross-section version of this invention is suitable only for those applications where requirements of extreme extend and compact retract are to be met.

Therefore, it is a purpose of this invention to provide a series of interacting fluid actuated tube and piston sections capable of being positively expanded or contracted collinearly from a single section, as compared to conventional cylinders which either must depend upon gravity drop for one mode of operation, or be limited in travel by the unwieldy routing of a fluid pressure hose to the opposite or outermost cylinder section.

It is also an object of this invention to provide a shaft, rotationally drivable and simultaneously extendible or retractable.

It is also an object of this invention to provide a rotary shaft comprising telescoping sections, and which additionally includes a sleeve-like shuttle-barrel member which is concentric about the former, and which can be fluid actuated via common porting to raise or lower the cylinder, or inversely, to itself be raised or lowered relative to the said central sections.

It is also an object of this invention to provide a telescoping apparatus wherein an outer shuttle-barrel member is equipped with spiral ramps and leading edge cutters, thereby serving as an effective auger drill device which is capable of drilling and extracting while a central cylinder cutting head is working simultaneously as a pilot drill.

It is also an object of this invention to provide unique porting necessary to achieve the extreme compactness of the compound telescoping capability, while actuating means may be furnished through the innermost ram member in the case of a rotary power requirement, or via the outermost cylinder in standard fixed cylinder applications.

The above and other features of this invention reside in its simplicity of construction, efficient and dependable operation, and in its adaptability to convenient and competitive manufacture. With the foregoing more prominent objects and features in mind, other points of importance may become apparent as this specification proceeds. The invention will be more fully comprehended from the following description taken in conjunction with the accompanying drawings, wherein, like characters of reference are used to designate like parts, and wherein.

Figures 1, 2, 3, 4, 5, 6:
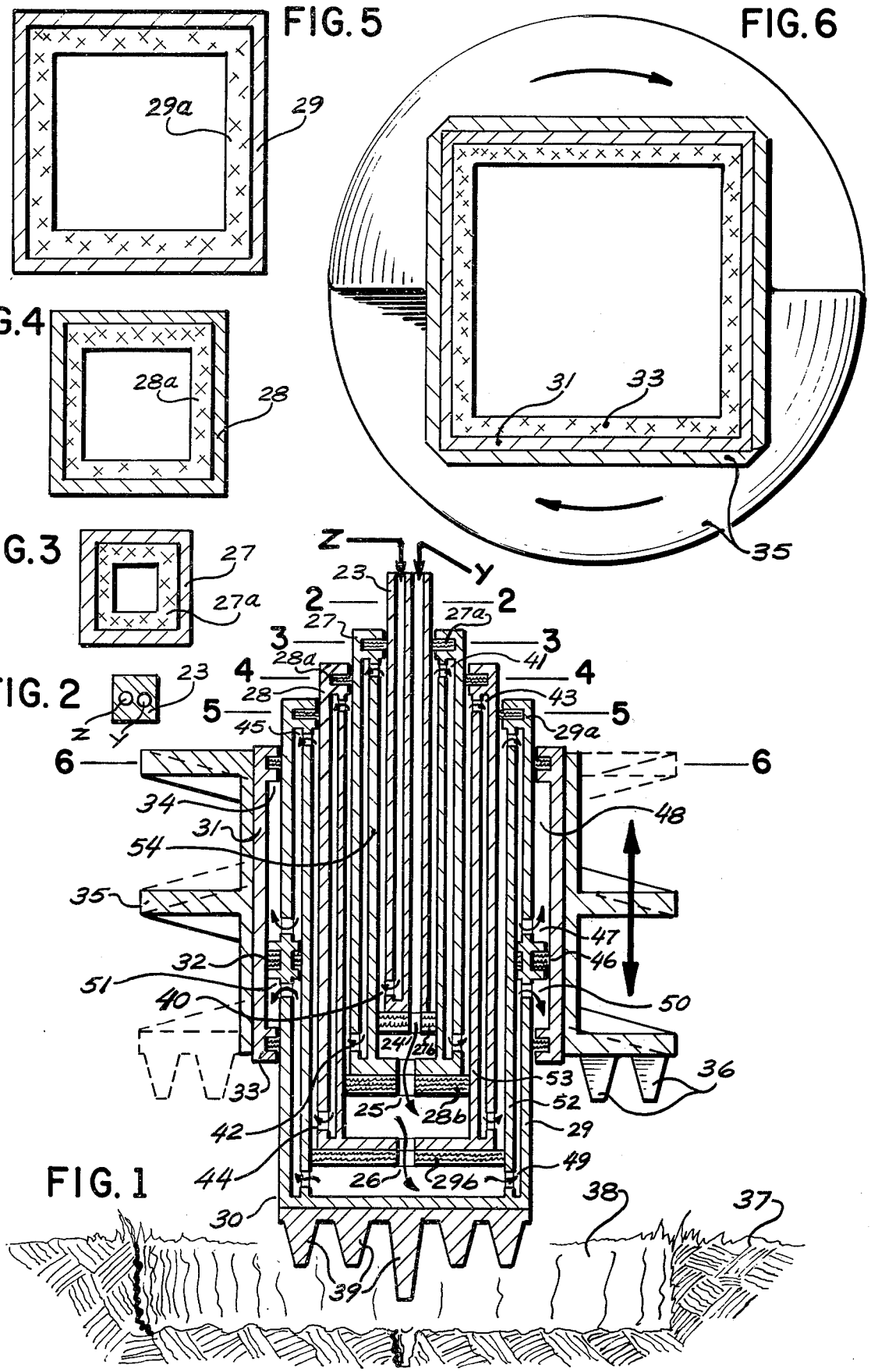
FIG. 1 is a cross-section side-view of an exemplified rotational drive cylinder, exposing preferred configuration of cooperating members.
FIG. 2 is a cross section view of the innermost shaft member of FIG. 1, taken at line 2—2 of FIG. 1.
FIG. 3 is a cross section view of the shaft member of FIG. 1 which is next outside that of FIG. 2, taken at line 3—3 of FIG. 1.
FIG. 4 is a cross section view of the shaft member of FIG. 1 which is next outside that of FIG. 3, taken at line 4—4 of FIG. 1.
FIG. 5 is a cross section view of the shaft member of FIG. 1 which is next outside that of FIG. 4, taken at line 5—5 of FIG. 1.
FIG. 6 is a view partly in cross section showing the shaft member of FIG. 1 which is next outside of that of FIG. 5, taken at line 6—6 of FIG. 1, and showing the auger.
Figure 7:
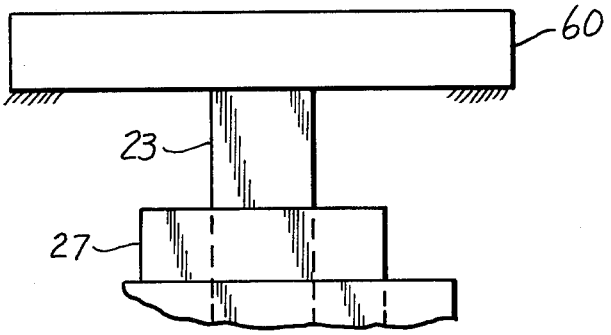
FIG. 7 illustrates the upper portion of the assembly of FIG. 1, and shows means for driving it in rotation.

Reference to FIGS. 1 through 6 reveals an assemblage of cylinder-like shaft members also cooperating in a manner as to permit extreme collinear expansion along a longitudinal axis from a compact state; however, this version permits a heavy-duty torque loading to be taken up through means of the stator-like resistance offered by the preferred square cross-sectioned members illustrated in FIGS. 2, 3, 4, and 5. It is also shown that initial hydraulic fluid entry at port Y controls the collinear expansion mode of the entire assemblage and is situated at base cylinder region 23 and acts in an otherwise conventional manner through ports 24, 25, 26 directly pressurizing cavities adjacent to respective seals 27*b*, 28*b*, 29*b* thereby effecting an extension of shaft members 27, 28, 29 in unison to any point within physical limits of travel available and in addition moves a larger cylinder member or sleeve previously described as a two-way shuttle-barrel 31, which is disposed about leading cylinder 30 and central rim seal 32 in a manner which permits longitudinal travel within the limits of end-seal/stop-flange 33 and 34. Through this method, it is seen that a unique inverted rotational drive, represented in block diagram form by numeral 60 in FIG. 7, is completed from driving shaft member 23 to the attached auger tool 35 which is shown replete with rather conventional spiral ramps and drilling cutter teeth 36 relative to surrounding earth terrain 37 and sample hole 38 also in cross-section view. Also important to the invention's efficiency in serving as a drilling fixture, are the unusual pilot drilling fly-cutters 39 located at the crown portion of cylinder member 29. Contraction of the cylinder assemblage is activated through release of pressure in port Y and transfer of pressure application to port Z which is in fluid communication with all stepped stages through virtue of a unique folded flow-path commencing at point 40 which represents a typical aperture of any suitable size and shape, and is in any case situated adjacent to seal 27*b*; whereupon the flow-path progresses forward, folding back lengthwise toward the next outer aperture 41, adjacent to seal 27*a*; next lengthwise back to aperture 42, adjacent to seal 28*b*; then returning again lengthwise to aperture 43, adjacent to outer seal 28*a*; then lengthwise back to aperture 44, adjacent to seal 29*b*; and finally lengthwise back towards seal 29*a*. Additionally, installations incorporating the special sleeve or shuttle-barrel assembly 31, require that extra aperture provisions be made at 45, adjacent to said seal 29*a*; and then fold back until wall 46 is met, and aperture 47 enters into the barrel cavity region 48 wherein hydraulic pressure causes the said barrel to shuttle upward until seal region 34 reaches the limit of its travel adjacent to region of said seal 29*a* which uniquely serves as an effective alternate position in providing a spin-off mode, for the emptying of extracted drillings, integrally within the length of the extendible cylinder members.

Inversely, the said shuttle-barrel member is brought to shift to the opposite end of the crown cylinder 30 through pressure entering from aperture 49 which travels lengthwise until meeting wall-seal 46, and aperture 50 allowing entry only into barrel cavity 51 thereupon shifting the shuttle-barrel and auger drill mounted thereon toward the normal drilling position, wherein seal-flange 33 is adjacent to the cylinder crown region supporting fly-cutters 39; thus, engaging additional cutting members 36 in the drilling process.

Note here, that intermediate adjacent members 52, 53, 54 are key tubular members with double walls providing a fluid flow channel between the two spaced walls of each double wall, installed to complete the unique folded flow-path system as provided within the interior of this double-acting, instantly reversible telescoping drive shaft configuration. FIGS. 2, 3, 4 and 5 of FIG. 1 expose the preferred form of these components, and it should also be noted that the preferred relationship is that of the square seals, or packing glands, 29*a*, 28*a*, 27*a* bearing against square shafts 28, 29, 23 respectively, as this effects a stator-like means of resisting any inner cylinder slippage. If the intermediate adjacent members 52, 53, 54 be round cross-sectioned they form compound chambers and serve as concentric cylinders within which are supported seals 29*b*, 28*b*, 27*b*; and around which, oil is suitably directed for a particular sequence of operation. Naturally, various work requirements will alter the size and number of components within the cylinder assemblage.

It is noted that seals 28*b* and 29*b* and the structures at the bottoms of the respective shaft members to which these seals are attached, and also the base portion of outer shaft member 30, act as piston elements relative to the next adjacent inner shaft member, inasmuch as pressurized fluid from fluid entry port Y pressurizes the respective cavities immediately above these respective piston elements. It is also noted that the respective seals 27*a*, 28*a* and 29*a* and the respective shaft member structure at which they are attached, act as piston elements inasmuch as pressurized fluid from entry port Z pressurizes the regions beneath these piston elements. The seal 27*b* at the bottom of the inner shaft member 23 is not a piston in the ordinary sense as it is on the drive shaft member 23 and all other shaft members are considered to be slidable relative to the drive shaft member. It is seen that each of shaft members 27, 28 and 29 has two piston elements. Thus shaft member 27 has the upper piston element at 27*a* and a lower piston element at 28*b*; shaft member 28 has an upper piston element 28*a* and a lower piston element 29*b*; and shaft member 29 has an upper piston element at 29*a* and a lower piston element which is the base of shaft member 29. The upper and lower piston elements of each shaft member are together referred to herein and in the claims as the piston means of the shaft member. The two seals at the respective two piston means of each of these shaft members are referred to herein and in the claims as seal means.

While the foregoing serves to illustrate and describe the preferred embodiment of the invention, various modifications may become apparent to those skilled in the art to which the invention relates. Accordingly, it is imprudent to limit the invention to the disclosure made herewith; as it is desired that various modifications be covered within spirit and scope of the appended claims.

I claim:

1. Earth drilling equipment comprising:

an extendible and contractible shaft, comprising at least three shaft members having a common longitudinal axis, drive means operable on one of said shaft members to apply torque for rotating it, each shaft member except the outermost shaft member, being telescoped within the next adjacent outer member, means preventing relative rotation between adjacent shaft members, each of said three shaft members except the one driven by the drive means having piston means slidably sealed to the inner wall of the next adjacent outer member and providing a series of tandem arranged seal means, fluid passageways between adjacent shaft members, means providing fluid communication between adjacent fluid passageways, a first port means for entry of pressurized fluid, communicating with a side of said seal means for applying pressure in the direction of expansion and a second port means for entry of pressurized fluid, communicating with another side of said seal means for applying pressure in the direction of contraction, whereby application of fluid pressure at said first entry port means extends the length of said shaft and application of fluid pressure at said second entry port means contracts the length of said shaft, and earth drilling means attached to one of said shaft members other than the member on which the drive means is operable.

2. Equipment according to claim 1 in which the means providing fluid communication between adjacent fluid passageways comprises channel means through the walls of the shaft members.

3. Equipment according to claim 1 in which the shaft members intermediate between the innermost and outermost shaft members have double walls providing a channel for fluid flow between the two walls of each double wall.

4. Equipment according to claim 3 in which the means preventing relative rotation between adjacent shaft members is a non-cylindrical configuration of the shaft members.

5. Equipment according to claim 1 in which the path of fluid flow from at least one of the port means is a folded flow-path.

6. Equipment according to claim 1 in which the outermost shaft member comprises a sleeve having two seals spaced apart from each other and located between the sleeve and the next inner shaft member, and a seal between said last-mentioned two seals so that when fluid pressure is applied at one of the ports, the sleeve is moved in one direction along said next inner shaft member and when fluid pressure is applied at the other port the sleeve is moved in the opposite direction along said next inner shaft member.

7. Equipment according to claim 6 in which an auger is fastened to the exterior of said sleeve.

8. Equipment according to claim 6 in which the drive means operates on the innermost shaft member.

9. Equipment according to claim 8 in which both said first and second port means pass through the innermost shaft member.

* * * * *